US005568706A

United States Patent [19]

Gerhing et al.

[11] Patent Number: 5,568,706

[45] Date of Patent: Oct. 29, 1996

[54] RIDGE AND/OR EDGE COVERING AND PROCESS FOR THE PRODUCTION OF A RIDGE AND/OR EDGE COVERING

[75] Inventors: Manfred Gerhing, Hermann-Hesse-Str. 23, D-72250, Freudenstadt; Hermann Schollmeyer, Heddesheim, both of Germany

[73] Assignee: Manfred Gehring, Freudenstadt, Germany

[21] Appl. No.: 350,689

[22] Filed: Dec. 7, 1994

[30] Foreign Application Priority Data

Dec. 10, 1993 [DE] Germany ..... 43 42 206.3
Sep. 30, 1994 [DE] Germany ..... 94 15 765

[51] Int. Cl.[6] ..... F24F 7/02

[52] U.S. Cl. ..... 52/198; 52/199; 454/365; 454/367

[58] Field of Search ..... 52/198, 199; 454/365, 454/367; 98/42.21

[56] References Cited

U.S. PATENT DOCUMENTS

| | | | |
|---|---|---|---|
| 4,558,637 | 12/1985 | Mason | 52/199 X |
| 4,907,499 | 3/1990 | James | 52/199 X |
| 5,052,286 | 10/1991 | Tubbesing et al. | 454/365 |
| 5,054,254 | 10/1991 | Sells | 52/199 |
| 5,095,810 | 3/1992 | Robinson | 454/367 X |
| 5,288,269 | 2/1994 | Hansen | 52/199 X |
| 5,332,393 | 7/1994 | Gödl | 454/365 |
| 5,427,571 | 6/1995 | Sells | 454/365 |
| 5,439,417 | 8/1995 | Sells | 52/199 X |

FOREIGN PATENT DOCUMENTS 9217733 12/1992 Germany .

*Primary Examiner*—Wynn E. Wood
*Attorney, Agent, or Firm*—Antonelli, Terry, Stout & Kraus

[57] ABSTRACT

A ridge and/or edge covering and a process for producing the same is characterized in that at least the inner portion or portions (2, 3) of the cover cap (1) are made from a permanent elastic, deformable material and that to a second inner portion (3) placed on both sides of the first central portion (2) and angled downwards with respect thereto are connected the outer portion or portions (11, 17) and at least one first outer portion (11) bent upwards with respect to the second inner portion (3) is provided with overflow areas (22), a third outer portion (17) is angled outwards with respect to the first outer portion and a second outer portion (14) serving as a sealing element is placed in the transition area (12) between the second inner portion (3) and the first outer portion (11) and that a permanent elastic, deformable material is provided in the longitudinal direction with folding means, so that several portions are obtained and are provided by punching with overflow openings, edge flanges, as well as plates and overflow areas and a second inner portion is angled downwards with respect to the first central portion and a first outer portion is bent upwards with respect to the second inner portion, a second outer portion is placed on the cover cap in the transition area between the second inner portion and the first outer portion and a third outer portion is angled outwards relative to the first outer portion.

25 Claims, 3 Drawing Sheets

RIDGE AND/OR EDGE COVERING AND PROCESS FOR THE PRODUCTION OF A RIDGE AND/OR EDGE COVERING

FIELD OF THE INVENTION

The invention relates to a ridge and/or edge covering, as well as to a process for the production of a ridge and/or edge covering, particularly for ridge ventilation purposes, with a ridge or cover cap having at least one inner portion, as well as one or more outer portions, the cover cap being provided with openings and folding means and in the installed state is fixed to a ridge and/or edge batten and is positioned below a ridge tile and the outer portion or portions of the cover cap are adaptable to the profiling of adjacent roof covering panels and are connected to a first portion, which rests in fixed manner as a support on the ridge and/or edge batten.

BACKGROUND OF THE INVENTION

A ridge and/or edge covering of the aforementioned type is known from German utility model 92 17 733. The ridge and/or edge covering described therein has a first portion, to which is connected a further portion, together with an outer portion, which is in each case fixed to a third portion. The first three portions are made from a rigid plastic and the outer portion from a slightly flexible, resilient and highly extensible material. Each of the portions is bendable with respect to the adjacent portion by means of folds running in the longitudinal direction of the cover strip. By means of the first portion the cover strip is fixed to the ridge or edge batten, in the second portion are formed bulges with openings by means of which ventilation takes place and the third portion has projections in the form of support studs, which serve as spacers with respect to the ridge tile, so as to always ensure a clearly defined gap width between the covering and the inside of the adjacent ridge or edge cap.

It is disadvantageous in the known covering that only the second portion has openings for ventilation purposes. Moreover, in said known covering the support studs are necessary on the cap sides in order to ensure an adequate flow between the ridge tile and the covering. As a result of these rigid support studs resistance is experienced by the through-flowing air, which can prevent an adequate ventilation and no flexible adaptation to the inner profiling of the ridge tile is possible. This does not adequately ensure a compensation of the step-like inner contour of the ridge tile.

Therefore the problem to be solved by the invention, whilst avoiding the aforementioned disadvantages, is to provide a ridge and/or edge covering and a process for the production of the latter, which utilizes the advantages of the known ridge and/or edge covering elements, but in which independently of the nature and construction of the roof covering a more effective ventilation over the ridge area is ensured.

SUMMARY OF THE INVENTION

According to the invention the above-stated problem is solved by a ridge and/or edge covering of the aforementioned type in that at least the inner portion or portions of the cover cap are made from a permanent elastic, deformable material and that to a second inner portion, which is placed on either side of the first, central portion and is angled downwards with respect thereto are connected the outer portion or portions and at least one first outer portion bent upwards with respect to the second inner portion is provided with overflow areas, a third outer portion is angled outwards relative to the first outer portion and a second outer portion is positioned as a sealing element in the transition area between the second inner portion and the first outer portion. A process according to the invention provides a permanent elastic, deformable material in the longitudinal direction with folding means, so that several portions are obtained, and is provided by punching with overflow openings, edge flanges, plates and overflow areas and a second inner portion is angled downwards relative to the first, central portion and a first outer portion is bent round upwards relative to the second inner portion, a second outer portion is placed in the transition area between the second inner portion and the first outer portion of the cover cap and a third outer portion is angled outwards relative to the first outer portion.

As a result of the construction according to the invention particularly of the outer portions between the underside or lower edge of the ridge tile and the top or upper edge of the ridge cap an inner, unsealed flow area is provided. The term roof tile is not to be understood in a restrictive sense in the present invention. It also applies to the elements covering the roof ridge or edge, such as the ridge bricks, ridge pantiles, etc. The flow or ventilation area is in each case laterally terminated by the upwardly bent and correspondingly high, first outer portion, which only frees segmental overflow areas. In this way the ventilation area is firstly open to both roof sides so as to ensure an unhindered outflow to the outside of the underroof air and the other area is protected to the greatest possible extent against the undesired entry of all types such as, rain, snow, etc. As a result of the through construction of the flow or ventilation area from the weather to the lee side there is no forced flow, as is the case with individual channels. Thus, e.g. wind entering obliquely into the flow area is not deflected as in the case of channels and is instead whirled up, so that the necessary underpressure for roof ventilation is provided. As a result the air flow can evolve and move in an unhindered manner.

Thus, both on hot summer days, due to the strong air flow, a good, rapid heat dissipation is ensured, and on cold, rainy days an improved, reliable removal of moisture in the ventilation gap below the roof tile is ensured. As a result of the construction of the first and third outer portions a spatial and force seal with respect to the ridge tile is ensured. Between the second inner and the third outer portion a type of hinge action occurs, so that the third outer portion can in each case be adapted in optimum manner to the inner surface of a ridge and/or edge tile. Thus, no in situ bending round is necessary, particularly due to the use of a permanent elastic, deformable material for the purpose of adapting the ridge or cap according to the invention to the given ridge and/or edge tile. The second outer portion bridges the gap between the roof covering panels and the adjacent covering elements in sealed manner. As the second outer portion is arranged as a sealing element on both sides of the cover cap, there is a complete sealing of the underroof area from one side of the roof to the other. As a function of the width of the second inner portion, as well as the first and second outer portion, the cover cap can be completely covered by the ridge tile or can project partly below the same. In the first case the cover cap is not directly exposed to rain and snow. If the cover cap projects partly below the ridge tile, as a result of the longer construction of the portions an improved hinge action is ensured.

According to a preferred development, the first and third outer portions are constructed in the form of a plurality of integrally telescoping, elastic lamellas or plates. Such a lamellar construction is characterized in that the cover cap can be easily adapted over the entire roof brick area and has an excellent stability. As a result of the lamellar construction of the third and first outer portions, there is an excellent adaptation to the step-like or conical contours of the ridge tile or brick frequently occurring in the ridge direction. Independently of one another the plates can either just contact the ridge tile or can engage fully with their outer or contact surface on the inner profile. It is merely necessary to place the ridge tile on the installed ridge cap in order to ensure an elastic and permanent connection between the ridge cap and tile. As a result of the construction according to the invention there is not only a support in the center of the ridge, so that the roof covering worker can safely walk over the same, but the plates also ensure a reliable outer support of the complete system.

The necessary flow cross-section for fulfilling the requirements of DIN 4108 is preferably obtained in that the intermediate spaces formed by a constant spacing between the plates serve as overflow areas.

According to a further development, the plates preferably constructed integrally with the second inner portion of the cover cap are provided on the longitudinal edges of the first outer portion with lateral flaps constructed integrally with said plates. These lateral flaps are preferably bent downwards and outwards, accompanied by the formation of an obtuse angle, with respect to the plates of the first outer portion, the angle being such that the cross-section of the overflow areas starting from the first outer portion tapers outwards and downwards. As a result of this nozzle-shaped design of the segmental overflow areas between the individual plates for the air flowing out of the ventilation area, the advantageous, low losses of a nozzle flow are obtained, whereas in the opposite direction the high flow losses of a "Borda" opening apply. In the case of free thermal convection without a cross wind the air flowing out of the roof into the flow area can flow out on either side through the segmental overflow areas in the first and optionally in the third outer portion. In the case of forced convection the air flowing in from the outside in the case of a cross wind is prevented from flowing in by the one-sided contour of the overflow areas in the first outer portion, particularly by contraction and whirling up on the flanged areas of the lateral flaps, whereas in the case of an outflow from the overflow areas located on the opposite roof slope there is a much lower resistance due to the rounding of the lateral flaps provided there. This leads to a limited underpressure in the gap between the ridge tile and cap, which advantageously has an effect on the flow from the roof interior through openings provided in the second inner portion. The possibly moist air is sucked from the roof interior not only on the lee side, but also on the weather side. A flow into the interior of the roof is prevented by the under-pressure present. In addition, rain or condensation water can flow away unhindered through the overflow areas into the outer portions. A penetration of water is prevented by the flanged edges of the lateral flaps and also by the bent, third outer portion.

In order to reinforce the effects of the nozzle-like overflow areas, the lateral flaps preferably taper to the outside from the particular plate or lamella.

In a further preferred construction, the plates of the third outer portion taper outwards on their free end. As a result the elasticity of the outer plates is increased, so that they can adapt without difficulty to any internal profile and ensure a permanent, elastic connection between the ridge tile and ridge cap. In order to reinforce this effect, the individual plates of the third outer portion can optionally be made somewhat narrower than the plates of the second outer portion. In the case of such a ridge cap the ridge tile is merely to be placed on the installed covering, there no longer being any need for a pressing action by the ridge brick as in the case of known plastic coverings, because the cover cap has already been formed prior to the fitting.

To ensure a fastening for receiving the second outer portion in the vicinity of the bend, the transition area between the second inner and first outer portion is preferably divided into flaps by transverse slits. Two adjacent flaps can have the same, but also a different width, whilst in the case of a different width which is preferred for flow reasons, the wider flaps can optionally pass into the plates of the outer portions for increasing stability. For the construction of the fastenings for the second outer portion, the flaps passing into the plates of the outer portions are bent downwards in the form of a reflected S and the flaps adjacent thereto in S-shaped manner, so that they form a clamping strip for receiving and fixing the second outer portion serving as a sealing element. Into the clamping strips can then be inserted outer portions with a different construction, the clamping action of outwardly and downwardly bent flaps ensuring a reliable fixing of the portions. There is no need to fit or shape additional fastenings on the cover cap, which also simplifies the manufacture of such a cap.

All that is important for the second outer portions, which can e.g. also have a different width, is that they sealingly bridge the gap between the roof covering panels and the adjacent covering elements.

Preferably, in the transition area between the flaps forming the clamping strip and the plates of the first outer portion there are longitudinal fins running perpendicular to the extension direction of the plates. As a result of the stiffening obtained in the area between the second inner and the first outer portion it is ensured that the clamping strips or fastenings and the sealing element inserted therein cannot be pressed outwards. The elastic construction between the inner and outer portions is correspondingly obtained between the third outer portion and the second inner portion.

The openings left in the transition area above the inserted sealing element as a result of the bending round and after inserting the second outer portion can act as drainage openings through which rain or condensation water can flow to the outside and so that it cannot penetrate the interior of the roof.

The second outer portions can be constituted in preferred manner by metal strips of aluminium, copper or lead. As a result of the use of these materials it is possible to bring about an almost complete recycling without the harmful effects and problems caused by plastics. In addition, the second outer portion is extremely strong, so that there is scarcely any material rotting. If the cover cap with its second outer portions projects under the ridge tile, then the latter is also not attacked by UV radiation, so that its life is increased. Such an embodiment is particularly preferable when use is made of a smooth terminating tile, which is provided with a step in the tile. One end of the metal strip is inserted in the clamping strip, whereas the other, in particular smooth end of the second outer portion e.g. with a width of 15 cm rests snugly on the roof tile step and correspondingly the ridge cap can be easily installed. In place of a metal strip it is also possible to use rubber strips, e.g. made from ethylene-propylene-diene terpolymers (EPDM). The use of copper has the advantage that it is subject to natural oxidation. The copper oxide washed off the metal by rain prevents any moss formation on the roof covering panels and over a long period of time gives the impression of a constantly new roof covering.

According to a preferred construction two metal strips, preferably made from different metals, are placed on one another. In an embodiment one metal strip can be of aluminium and the other of tinned lead.

The aluminium and the tin plating of the lead ensure that no lead carbonate passes into the waste water or sewage system. Moreover, when using aluminium and tinned lead an ideal adaptation to each tile shape is ensured.

In another embodiment aluminium is once again used for one metal strip, but the other is constituted by colour-coated lead. This firstly leads to an additional corrosion protection and secondly when using a red or brown coating a surface corresponding to the tile colour can be used.

Moreover, the lower metal strip is at the end remote from the clamping strip embedded in the latter by the folding back of the upper metal strip. This ensures an optimum sealing of the second outer portion at the end facing the tiles. It is e.g. ensured that air can penetrate the area between the two metal strips, which is particularly desirable if the lateral strips are not completely covered by the ridge tile or brick and instead partly project below the same. As the second outer portions are then directly exposed to the rain and snow, the latter cannot penetrate between the metal strips.

In the embodiments described hereinbefore the metal strips can be either corrugated or non-corrugated.

In order to be able to reliably fix the second portion in the clamping strips, the metal strips either have an especially constructed marginal area or a marginal area is fixed in an additional metal back. For this purpose the metal strips can have a cross-sectional reduction in the marginal area. In the area remote from the metal back it is possible to bend the strip for better engagement on the roof covering panels.

The metal back can e.g. be made from high-grade steel or from galvanized sheet metal. Such a metal back is also usable for other embodiments of the second outer portion, e.g. when using a rubber strip, which would otherwise have to be provided with an especially constructed marginal area.

In another preferred construction of the invention the second outer portion of the cover cap comprises a brush-like element. The bristles of such a brush-like element can extend both to the bottom of the corrugation valleys of the roof covering panels or roof tiles, but in the vicinity of the highest protuberances of the roof covering panels can also be spread or pressed away. Therefore such a brush-like element can be sealingly applied to the most varied contours. In the vicinity of the engagement on the roof covering panels or roof tiles the element also has the necessary flexibility and softness, so that it sealingly adapts to the contours of the panels or tiles under even the slightest force action.

With particular advantage the brush-like element has bristles made from aluminlum wires or copper wires. As these bristles, which can also project below the ridge tile, are exposed to the weather and therefore to UV rays, the inventive construction provides a particularly weatherproof and strong, second outer portion of the cover cap. In place of aluminium wires the brush-like element can also have natural fibres as bristles, e.g. horse hair bristles. Through the use of such natural fibres a cover cap is provided, which will subsequently not give rise to any waste disposal problems.

If the brush-like element is stepped towards the roof covering panels, it is particularly well engageable on the contour of the panels. Thus, on steep roofs it is possible to reduce the bristle pressing values and the individual bristles are uniformly and flatly applied to the roof covering panel contour. In place of brush-like elements the second outer portion can also be constituted by filter foam sealing bodies, which preferably have a wedge-shaped construction, or use can be made of a dimensionally stable fabric strip. When using such sealing bodies there is no need to pay attention when applying the cover cap to the ridge batten with respect to the profiling of the roof covering panels. The second outer portion can also be a plastic part adapted to the profiling of the roof covering panels. It is also possible for the portion to have a comb-like construction. As a result of its flexible teeth, such a comb-like portion can adapt without difficulty to any external profile. In addition, the second outer portion can be a soft, extensible polyisobutylene film strip in which is embedded a metal mesh, which in particular in the longitudinal direction has an extensibility of 50 to 150% and in the transverse direction an extensibility of 20% and a recovery capacity of <0.5%. When using a cover cap with such an outer portion a random profiling of the roof covering panels is possible, because the portion has a high extensibility in the longitudinal direction. The limited extensibility in the transverse direction ensures that the cover cap fitted under the ridge tile also gives an optically attractive appearance, if the outer portion projects under the ridge tile, because the latter then has a clean longitudinal edge. Using adhesives the second outer portion can be fixed in optimum manner to the roof covering panels and is thereby optionally bonded.

Nowadays increasing importance is being attached to the economic reuse of old and waste materials by the return thereof to the material cycle. In the case of conventionally used materials such as rigid plastics recycling is particularly difficult, especially if construction has taken place in conjunction with other materials. If recycling is not possible, all that is available consists of dumping or incineration with the resulting, undesirable environmental problems. Another disadvantage when using plastics is that they are not sufficiently resistant to increasing UV radiation, so that even plastics such as polyvinyl chloride (PVC) are attacked.

Thus, according to further developments, the permanent elastic, deformable material is also metal and both the first and third outer portions are also made from metal. The metal can be aluminium, copper or galvanized sheet metal. Through the use of aluminium, copper or galvanized sheet metal for the cover cap it is possible to bring about an almost complete recycling. Thus, such a covering does not lead to the problems which occur when using plastics. In addition, the cover cap according to the invention is extremely strong, so that there is scarcely any material rotting. In addition, UV radiation, particularly increasing UV radiation, does not attack the cover strip, so that the service life is increased compared with conventional cover strips. The durability can be in the range of the 30 year guarantee given by tile manufacturers for their tiles. Moreover, when using aluminium or copper plates an ideal adaptation to any tile shape is ensured. The aluminium or galvanized sheet metal are generally of a single color, but are preferably coated in a two-color manner. This leads to an additional corrosion protection and also when using a red or brown coating the surface corresponds to the tile colour.

The metal used for the inner, as well as the first and third outer portions preferably has a thickness of at least 0.2 mm, but max 1.5 mm. Cover caps with a greater sheet metal thickness can no longer be adequately deformed. If the sheet metal thickness is smaller, then the metal cap is no longer adequately stable.

In order to permit an outflow of "humid" air from the underroof area into the ventilating area and from there to the outside, the openings serving as overflow openings are located in the second inner portion and are provided with flanges on their edges. These overflow openings are provided in the falling part of the cover cap due to the angling or bending of the second inner portion. As a result of the edge flanges the overflow openings are protected against the penetration of water running off the covering and an optimum air flow pattern is ensured. Preferably the overflow openings are aligned with the lamellas or plates, so that they have an optimum protection against air flowing in from the outside.

In the case of the overflow openings they can e.g. be oval, rectangular or rectangular openings with slightly rounded edges arranged parallel or at right angles in the plates, the rectangular or oval openings also being arrangeable in reciprocally displaced two row manner on the second inner portion. There can also be individual, round openings, which are aligned with the plates, but there can also be two superimposed round openings. The choice of the corresponding openings depends on the desired air flow to be obtained. As a result of the punching out of all these overflow openings and also the overflow areas, in the ridge or cover cap according to the invention it is ensured in space-saving manner that there are further ventilating and venting openings and areas as compared with the prior art. The stability of such a cover cap is in no way reduced compared with known cover caps.

As a result of the transverse channels provided according to the invention in the first central portion the cover cap in the upper area over the ridge batten is reinforced, so as to prevent a gutter-like bulging with the risk of stagnant water.

Such a cover cap can be slightly preshaped as a result of the punching and bending round actions prior to installation on a ridge batten. If the ridge cap is somewhat more prebent, then following nailing or screwing onto the ridge batten a good pretension is obtained, which in the case of a plastic covering would disadvantageously only be produced by the ridge brick or tile. Thus, in the case of the ridge cap according to the invention it is possible to check prior to the fixing of the ridge tile whether there is a clearly defined optimum engagement and support of the said tile. In addition, the ridge cap can be adapted to steeper roofs, in that it is correspondingly preshaped. Due to the fact that the sealing elements are insertable in the fastenings shaped as sturdy fastening clamping strips on the lower edge of the cover cap, the covering can be easily stacked. The possibility of stacking also exists to a limited extent with sealing elements fitted in the clamping strips.

Due to the fact that nail holes are punched into the permanent elastic, deformable material, the cover cap can be reliably fixed to the ridge batten. However, alternatively, the cover cap can be screwed on the ridge batten.

The ridge caps cut to a predetermined length after manufacture are preferably asymmetrical and during installation are so placed on one another that two transverse channels in each case engage in or rest on one another. Thus, the pattern of the central part remains constant over the entire ridge. In addition, the central portion of the ridge cap can be provided with a central marking, so that the cap can be precisely mounted on the ridge or edge batten.

The aforementioned and further features can, according to the invention, be used singly or in the form of random combinations. The first embodiments are not to be understood as enumerations restricting the invention and instead have an exemplified character.

BRIEF DESCRIPTION OF THE DRAWINGS

Further advantages and features of the invention can be gathered from the description with respect to an embodiment of the ridge and/or edge covering according to the invention and with reference to the attached drawings, wherein show.

DETAILED DESCRIPTION OF THE DRAWINGS

Figure 1:
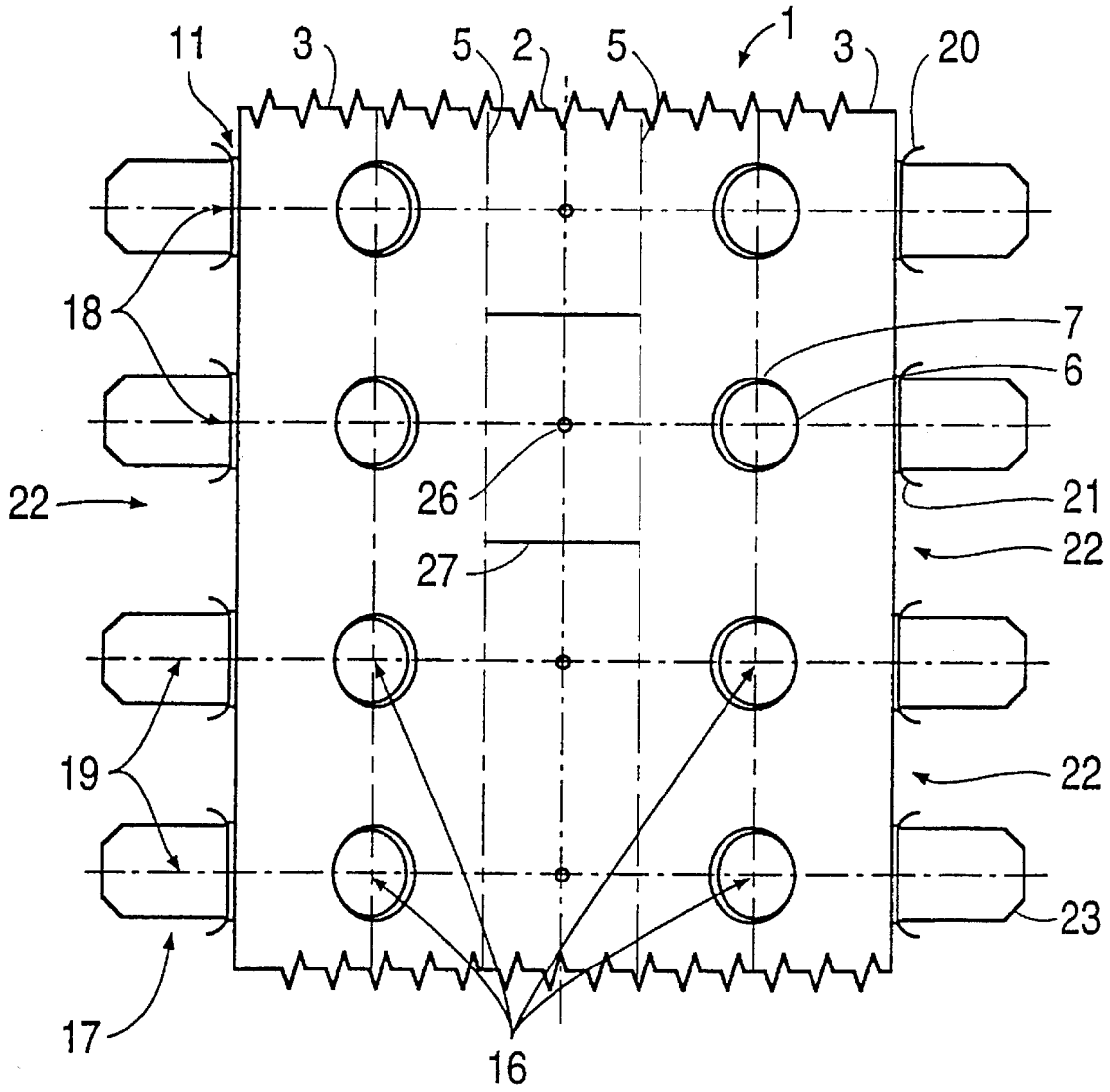
FIG. 1 A plan view of a cover cap according to the invention.

The ridge or cover cap 1 of a ridge and/or edge covering shown in FIG. 1 has a first, central portion 2, to which is connected on either side a second inner portion 3. As can be gathered from FIG. 2, the adjacent portions 2 and 3 are angled against one another, accompanied by the formation of an obtuse angle. This angling or bending takes place by means of folding means 5, which are located in the transition area between the first central portion 2 and the second inner portion 3. As can be gathered from FIGS. 3 and 4, the cover cap according to the invention is fixed by means of the first central portion 2 to a ridge batten 4 and is in particular nailed or screwed thereon.

According to FIG. 1 the second inner portion 3 is provided in its longitudinal direction with overflow openings 6, which are provided on their edges with flanges 7. Around the flanges 7 are passed the liquids flowing from the cover cap 1 so that they do not pass into the roof interior 8. In the represented embodiment the openings 6 are round. However, they can also be oval, rectangular or rectangular with more or less rounded corners, the openings being oriented parallel or perpendicular to the folding means 5. On the second inner portion 3 can also be provided several rows of overflow openings with optionally reciprocally displaced openings. By means of the overflow openings 6 distributed in uniform longitudinal manner over the entire cover cap 1 in this embodiment the air (cf. FIGS. 3 and 4) can flow out of the underroof area 8 and into the ventilating area 9 between the cover cap 1 and a ridge tile 10 or a ridge brick or a ridge pantile positioned above the same.

Figure 2:
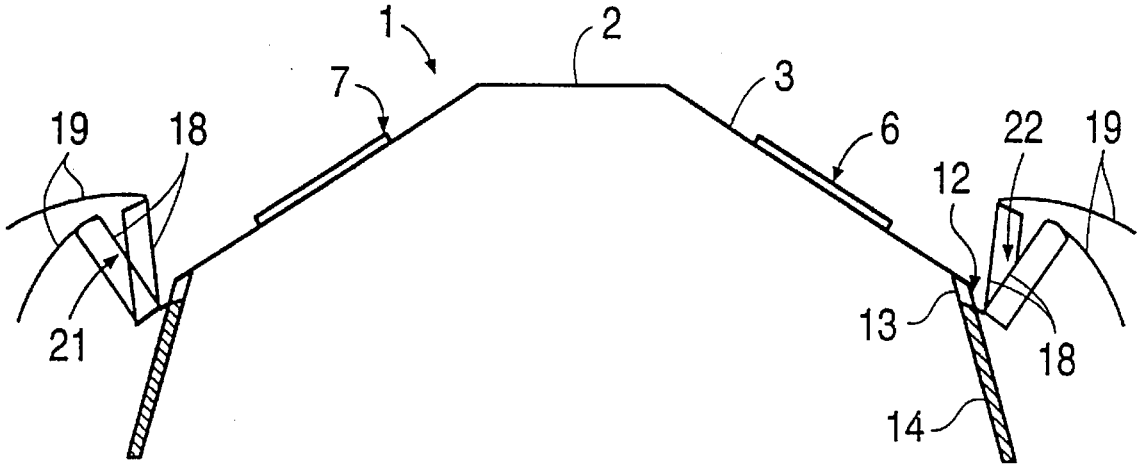
FIG. 2 A cross-section through the cover cap of FIG. 1.
Figure 3:
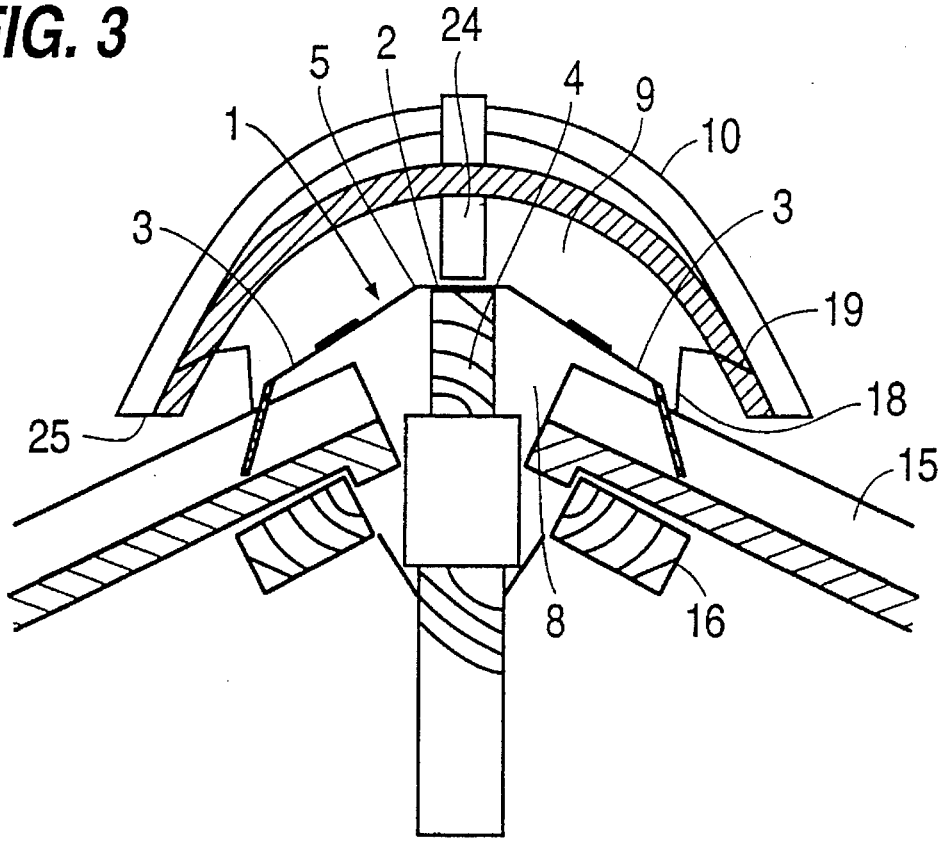
FIG. 3 A cross-section through a ridge area of a roof with the cover cap in its widest position.
Figure 4:
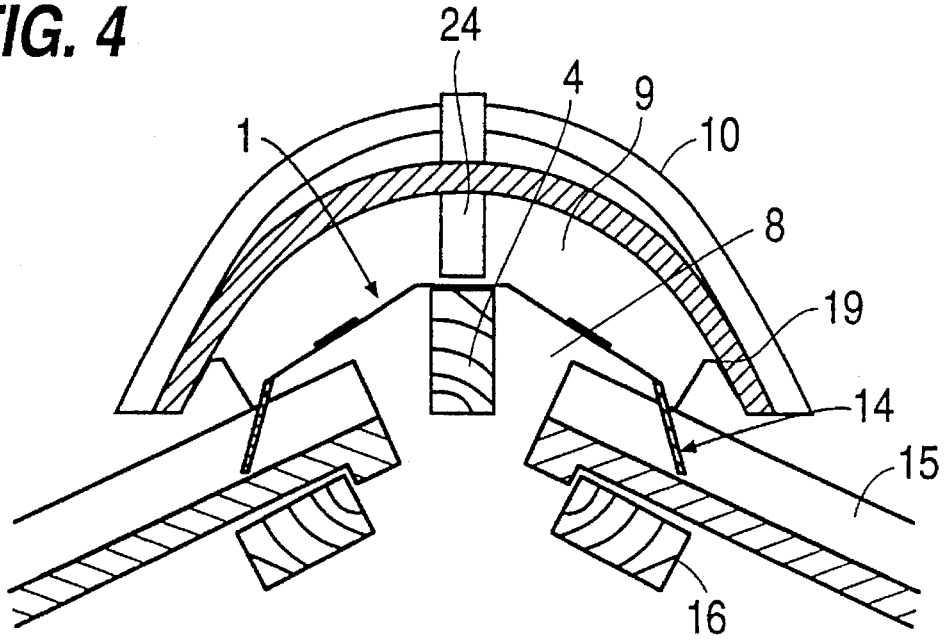
FIG. 4 A cross-section through a ridge area of a roof with a cover cap in its narrowest position.

To the second inner portion 3 is connected a first outer portion 11 (cf. FIGS. 2 to 4). In the transition area 12 between the second inner portion 3 and the first outer portion 11 fastenings 13 are formed. These fastenings 13, which are only intimated in FIGS. 2 to 4, are obtained in that the transition area 12 between the second inner portion 3 and the first outer portion 11 is subdivided by (not shown) transverse slits into also not shown flaps. Adjacent flaps can have a different width. In the case of a different width the narrower flaps are S-shaped and the wider flaps are in the form of a reflected S, being bent downwards against one another in such a way that they then form the clamping strip 13 serving as a fastening for receiving and fastening a second outer portion 14, which acts as a sealing element. The sealing element 14 is adapted in optimum manner to the profiling of the adjacent roof covering panels 15, which rest on the roof battens 16 of the roof truss.

At the end of the flaps of the clamping strip 13 bent downwards in the form of a reflected S, the first outer portion 11 is bent upwards. Longitudinal fins running perpendicular to the flap extension direction are provided in this area for stiffening purposes. To the first outer portion 11 is then connected a third outer portion 17, which is angled outwards by bending round with respect to the portion 11. Both the first outer portion 11 and the third outer portion 17 are constructed in the form of a plurality of integral elastic lamellas or plates 18, 19, which via the flaps of the transition area 12 pass into the second inner portion 3 of the cover cap 1. The entire inner portions 2, 3 and the outer portions 11, 17 are constructed in one piece with one another. Only the second outer portion 14 is separately produced and is inserted in the strongly constructed clamping strips 13.

If the flaps of the transition area 12 are provided with a different width, then the wide flaps pass in the form of a step in the vicinity of the longitudinal fins into the then somewhat narrower plates 18 of the first outer portion, which is provided on its longitudinal edges with lateral flaps 20, 21 constructed in one piece with the plates 18. The lateral flaps 20, 21 are bent downwards and outwards with respect to the plates 18. The intermediate spaces 22 of the cover cap 1 formed between the plates 18 and the lateral flaps 20, 21 serve as overflow areas through which the air can flow out of the ventilating space 9 or also into the latter. As can be gathered from FIG. 1, the overflow openings 6 are aligned with the plates 18, 19, so that they are protected against inflowing air.

The lateral flaps 20, 21 of the plates 18 of the first outer portion 11 are so bent downwards and outwards that, starting from the first outer portion 11, the overflow areas 22 taper downwards and outwards. In the same way, starting from the particular plate 18, the lateral flaps 20, 21 taper outwards. The resulting nozzle-shaped contour of the overflow area has, for the air flowing out of the ventilating area 9, the advantageous low losses of a nozzle flow, whereas the air flowing in from the outside is subject to the high flow losses of a Borda-like opening. In the case of free convection the air flowing out from the roof interior or underroof area 8 can flow outwards on either side through the overflow openings 6 into the ventilating area 9 and from there via the overflow areas 22 to the outside. In the case of forced convection the air flowing in from the outside is prevented from entering as a result of the contour of the overflow areas 22, whereas the air flowing out from the ventilating area 9 on the facing roof slope can flow out through the overflow openings 22 provided there due to the much lower resistance.

In the represented embodiment the plates or lamellas 19 of the third outer portion 17 are somewhat smaller than the plates or lamellas 18 of the first outer portion 11. At the free end 23 thereof, the plates 19 taper to the outside. This free end is adapted in optimum manner to each inner contour of the ridge tile or brick 10. As a result of the bending and shaping of the first outer portion 11 and the third outer portion 17, there is consequently a flexible construction of the cover cap between the second inner portion 3 and the third outer portion 17, which further reinforces the optimum adaptation to the inner contour of the ridge tile 10.

The first and third outer portions 11, 17 are not only used for the ventilation and venting of the ventilating area 9 and the roof interior 8, but also ensure an adequate intermediate space between the ridge tile 10 and the cover cap 1 and also provide a seal for the through flow or ventilating area 9 between the top of the cover cap 1 and the underside of the ridge tile 10.

The ridge tile or brick 10 is fixed by means of clips 24 to the ridge batten 4 and is spaced from the cover cap 1 in order to form the through flow area 9. In the embodiment of FIGS. 3 and 4 it projects with its edges 25 over the sealing elements 14 of the cover cap 1. This ensures the necessary intermediate space or ventilating area 9 between the cover cap 1 and the ridge tile 10, particularly the underside of the latter necessary for an optimum venting and ventilation. Correspondingly air flowing into the intermediate space 9 can carry along air flowing out from the roof interior 8 and pass it into the environment.

In the central portion 2 of the ridge cap 1 are punched nail or screw holes 26, which are preferably positioned between the overflow openings 6. Transverse channels 27 are punched from below in the central portion and are displaced with respect to the overflow openings 6. These transverse channels 27 serve to reinforce the ridge or cover cap 1 in the upper part over the ridge batten 4 and prevent a gutter-like bulging with a risk of stagnant water.

In order to be able to interconnect the individual cover caps 1 in the ridge area, at one end of the cover cap can be provided grooves or slits, while at the other end of the cover cap is provided a tongue which engages in the groove or slit. This tongue can e.g. have a wedge-shaped construction in order to ensure a reliable hold in the groove or slit of the other cover cap. Alternatively thereto on the inner portions of the asymmetrically constructed cover cap can be connected an overlap portion which is bevelled on its outsides and which can be placed on the following cover cap in such a way that in each case two transverse channels rest on or engage in one another. Thus, the pattern remains constant over the entire ridge.

The production of the ridge and/or edge covering takes place in that initially a permanent elastic, deformable material, e.g. an aluminlum, copper or galvanized metal plate with a thickness of optionally 0.5 mm is longitudinally provided with folding means. In the thus fixed inner portions overflow openings with edge flanges are obtained through longitudinal punching. A first and a second outer portion are punched out in lamella form and on the longitudinal edges of the lamellas of the first outer portion lateral flaps are left. The transition area between the second inner and the first outer portion is provided with transverse slits by punching or cutting in order to form flaps in this transition area. On the end remote from the central portion the flaps are provided with longitudinal fins extending perpendicular to their extension direction, e.g. by stamping. In addition, the central inner portion is provided with transverse channels by stamping from below. Between the transverse channels are punched openings for the fixing of the cover cap to the ridge batten.

The individual portions of the sheet metal are now angled against one another by folding or bending round. This takes place in that the second inner portion is angled downwards with respect to the first central portion, the flaps in the transition area between the second inner portion and the first outer portion are angled downwards in S-shaped manner or in the form of a reflected S, so that a clamping strip is created for receiving the second outer portion, the first outer portion is bent upwards at the end of the transition area and the third outer portion is bent outwards with respect to the first outer portion. The lateral flaps are so bent downwards and outwards with respect to the lamellas of the first outer portion, that in the cross-section thereof downwardly and outwardly tapering overflow areas are obtained.

In the clamping strips of the cover cap optionally brought to a predetermined length can be inserted the sealing elements in a slightly prebent manner (max 30°), so that on application to the ridge batten no excessive stresses occur on the clamping strips.

A cover cap made in this way and preshaped downwards has at the time of the installation of the ridge covering a good pretension, which in the case of a plastic covering is only produced as a result of the ridge brick, tile or pantile. With the cover cap according to the invention, after fixing and prior to the fitting of the ridge brick, the position of the covering and the sealing elements with respect to the roof covering panels and consequently the sealing function of the ridge covering can be checked. A pressing with corresponding deformation of the cover cap as in the prior art no longer takes place through the fitting of the ridge tile or brick.

As a result of the construction according to the invention with elastic plates as the first and third outer portions, the conical inner contour of the ridge tile can be compensated in an optimum manner. The outer or contact surface of the plates can engage completely on the inside of the ridge tile (cf. FIG. 4). However, it is also adequate from the stability standpoint if they are just in contact with the inside of the ridge tile (FIG. 3).

We claim:

1. A covering for ridge ventilation comprising:

a cap having openings, a first inner portion made from a material which is permanently elastically deformable and having first and second opposed sides, a pair of second inner portions made from a material which is permanently elastically deformable and each having first and second opposed sides and a pair of outer portions, a first side of one of the pair of second inner portions being joined to the first side of the first inner portion with a fold and being bent downward relative to the first inner portion and a side of one of the pair of outer portions being joined to a second side of the one of the pair of second inner portions and being bent upward relative to the one of the second inner portions to define an overflow area, a first side of another of the pair of second inner portions being joined to the second side of the first inner portion with a fold and being bent downward relative to the first inner portion and a side of another of the pair of outer portions being joined to a second side of the another of the pair of second inner portions and being bent upward relative to the another of the second inner portions to define an overflow area, each outer portion being comprised of an inner part, an intermediate part and an outer part with the intermediate part of each outer portion being a sealing element in a transition area between the second inner portion and the inner part and the outer part of each outer portion angling outwards relative to the inner part, the inner part and the outer part comprising a plurality of elastic plates with intermediate spaces being defined by a space between the elastic plates functioning as overflow areas and a cross section of the overflow areas tapering outward and downward extending from the inner part.

2. A covering in accordance with claim 1 wherein:

longitudinal edges of the plates of the inner part have lateral flaps constructed as one piece within the plates.

3. A covering in accordance with claim 2 wherein:

the lateral flaps are bent downwards and outwards with respect to the plates of the inner part.

4. A covering in accordance with claim 3 wherein:

the lateral flaps taper outward starting with the inner part.

5. A covering in accordance with claim 1 wherein:

plates of the outer part taper outward on a free end thereof.

6. A covering in accordance with claim 1 wherein:

the transition area is subdivided into flaps by transverse slits.

7. A covering in accordance with claim 6 wherein:

the flaps pass into the plates of the inner and outer parts and are bent downwards into a form of a reflected S and adjacent flaps are bent in a form of an S to form a clamping strip for receiving and fixing the first part.

8. A covering according to claim 7 wherein:

the transition area forms a clamping strip and the plates of the inner part have longitudinal fins perpendicular to an extension direction of the plates.

9. A covering in accordance with claim 1 wherein:

the intermediate part is formed from metal strips.

10. A covering in accordance with claim 9 wherein:

two metal strips of the metal strips can be fixed together.

11. A covering in accordance with claim 9 wherein:

the metal strips are corrugated.

12. A covering in accordance with claim 9 wherein:

an area of the metal strips is fixed in a metal back.

13. A covering in accordance with claim 11 wherein:

the intermediate part is a rubber strip.

14. A covering in accordance with claim 1 wherein:

the intermediate part is a brush-like element.

15. A covering in accordance with claim 1 wherein:

the permanently elastically deformable material is metal.

16. A covering in accordance with claim 15 wherein:

the inner and outer parts are made from metal.

17. A covering in accordance with claim 1 wherein: the portions have a thickness ranging from 0.2 mm to 1.5 mm.

18. A covering in accordance with claim 1 wherein:

the openings function as overflow openings having flanges on edges thereof and are located in the second inner portions.

19. A covering in accordance with claim 18 wherein:

the openings are aligned with the plates.

20. A covering in accordance with claim 1 further comprising:

transverse channels formed in the first inner portion.

21. A process for making a covering for ridge ventilation comprising:

forming a cap having openings, a first inner portion made from a material which is permanently elastically deformable and having first and second opposed sides, a pair of second inner portions made from a material which is permanently elastically deformable and each having first and second opposed sides and a pair of outer portions, joining a first side of one of the pair of second inner portions to the first side of the first inner portion with a fold and bending the one of the pair of second inner portions downward relative to the first inner portion and joining a side of one of the pair of outer portions to a second side of the one of the pair of second inner portions and bending the one of the pair of outer portions upward relative to the one of the second inner portions to define an overflow area, joining a first side of another of the pair of second inner portions to the second side of the first inner portion with a fold and bending the another of the pair of second inner portions downward relative to the first inner portion and joining a side of another of the pair of outer portions to a second side of another of the pair of second inner portions and bending the another of the pair of outer portions upward relative to the another of the second inner portions to define an overflow area, forming each outer portion to comprise an inner part, an intermediate part and an outer part with the intermediate part of each outer portion being a sealing element in a transition area between the second inner portion and the inner part and the second part of each outer portion angling outwards relative to the inner part, the inner part and the outer part being formed with a plurality of elastic plates with intermediate spaces defined by a space between the elastic plates functioning as overflow areas and a cross section of the overflow areas tapering outward and downward extending from the inner part.

22. A process according to claim 21 further comprising:

punching the first and second parts into lamellas with longitudinal edges of the lamellas of the first part having lateral flaps.

23. A process in accordance with claim 22 further comprising:

bending the lateral flaps downward and outward with respect to the lamellas of the first part to form the overflow areas between the lamellas.

24. A process in accordance with claim 22 further comprising:

forming slits for forming the lateral flaps of the lamellas of the first part and forming the flaps to pass into the lamellas of the second part in a reflected S configuration and adjacent flaps into an S configuration to create a clamping strip for receiving the second part.

25. A process in accordance with claim 24 further comprising:

prebending the second part; and inserting the pre-bent second part in the clamping strip.

* * * * *